US005769143A

United States Patent [19]

Morgan et al.

[11] Patent Number: 5,769,143

[45] Date of Patent: Jun. 23, 1998

[54] VENETIAN BLIND WITH SMOOTH BOTTOM RAIL

[75] Inventors: Joe N. Morgan, Otterbein; Jay R. Cleaver, Lafayette; Mark A. Parker, Lafayette; William C. Schultz, Lafayette, all of Ind.

[73] Assignee: Lafayette Venetian Blind, Inc., West Lafayette, Ind.

[21] Appl. No.: 618,985

[22] Filed: Mar. 20, 1996

[51] Int. Cl.[6] ..... E06B 9/30

[52] U.S. Cl. ..... 160/168.1 R; 160/173 R; 160/174 R; 160/178.1 R

[58] Field of Search ..... 160/115, 166.1 R, 160/167.1 R, 168.1 R, 173 R, 174 R, 176.1 R, 177 R, 178.1 R, 178.3 R, 236

[56] References Cited

U.S. PATENT DOCUMENTS

| | | | |
|---|---|---|---|
| 2,200,349 | 5/1940 | Walker | 160/168.1 R X |
| 2,402,894 | 6/1946 | Jablin | 160/173 R |
| 2,407,554 | 9/1946 | Isserstedt | 160/168.1 R X |
| 2,481,714 | 9/1949 | Bezjain . | |
| 2,493,186 | 1/1950 | Delgaudio . | |
| 2,529,229 | 11/1950 | Sherwood | 160/173 R X |
| 2,573,700 | 11/1951 | Ferguson et al. | 160/168.1 R X |
| 2,587,756 | 3/1952 | Palmisano | 160/168.1 R |
| 2,652,111 | 9/1953 | Walker . | |
| 2,723,716 | 11/1955 | Berni | 160/168.1 R |
| 2,754,898 | 7/1956 | Walker | 160/168.1 R X |
| 2,812,022 | 11/1957 | Lawson | 160/173 R |
| 4,441,540 | 4/1984 | Tsuhako | 160/168.1 R |
| 4,708,188 | 11/1987 | Bytheway, Jr. . | |
| 4,951,729 | 8/1990 | Yu . | |
| 5,127,458 | 7/1992 | Schaefer et al. . | |
| 5,176,193 | 1/1993 | Yannazzone . | |
| 5,205,335 | 4/1993 | Horton et al. | 160/168.1 R |
| 5,375,642 | 12/1994 | Gaber et al. . | |
| 5,402,840 | 4/1995 | Jortner et al. | 160/115 |
| 5,582,226 | 12/1996 | Voss et al. | 160/168.1 R |

*Primary Examiner*—Kenneth J. Dorner
*Assistant Examiner*—Bruce A. Lev
*Attorney, Agent, or Firm*—Woodard, Emhardt, Naughton, Moriarty & McNett

[57] ABSTRACT

In all three versions, the bottom rail has a flat, smooth bottom and does not tilt. In two versions, transverse horizontal holes receive ladder cords. In one of these versions, another horizontal hole opening at the rear of the rail extends obliquely into intersection with the transverse hole midway between the front and rear of the rail. A vertical hole extends down from the rail top to this intersection. A lift cord extends down through the vertical hole into the oblique hole where a knot on the lift cord fixes the end of the cord in the oblique hole. In too the other of these two versions, a horizontal transverse hole above each ladder cord hole receives a lift cord which extends out at the front and rear of the bottom rail. These lift cords, and the ladder cords, extend entirely up to the headrail. In this version, each slat has a notch at the front edge and rear edge, receiving the corresponding lift cord and ladder cord. These notches are small so when the blind is closed, they are covered by the next adjacent slat. A supplemental slat under the bottom slat has deeper notches so when the blind is closed, the supplemental slat descends, unlimited by the slat support strands, into gap closing contact with the bottom rail. The third version has notched slats but decorative ladder tapes are fastened to the front and rear faces of the bottom rail and hide the lift cords.

5 Claims, 10 Drawing Sheets

VENETIAN BLIND WITH SMOOTH BOTTOM RAIL

BACKGROUND OF THE INVENTION

1. Field of the Invention

This invention relates generally to venetian blinds, and more particularly to improvements in the appearance and performance of such blinds.

2. Description of the Prior Art

Venetian blinds have been in use for many, many years. Some construction features have not changed much in recent years. One component of such blinds is the bottom rail. Typically there are at least two ladder cords or straps extending across the bottom of the bottom rail in two spaced locations along the width of the blind. Also there are two lift cords with knots or retainer pins at the bottom of the bottom rail, with the lift cords extending up from the knots through holes in the bottom rail and through holes in all of the slats up to the headrail through which the cords extend, and out one end of the headrail to a pull cord to enable raising and lowering the blind. The presence of the ladder cord or tape and the knotted end of the lift cord at the bottom of the bottom rail detracts form the appearance of the bottom rail. It also requires some means to maintain the location of the ladder cord constant with reference to the ends of the bottom rail. In some instances this is done by a clip secured to the bottom rail which, to some people, might be considered decorative and, to others, might be considered purely functional. In any case, the bottom of the bottom rail is interrupted, which is detrimental to appearance, particularly when the blind is raised, and also tends to cause instability of the bottom rail if it comes to rest on a ledge or sill when the blind is lowered. In addition, when the blind is lowered and rests on a sill or ledge, the protrusions from the bottom rail cause gaps between the bottom rail and the sill. Such gaps permit the passage of light under the bottom rail, undermining one of the desired functions of the blind. In addition, where the blind is intended to inhibit heat transmission between exterior and interior space, the gap interferes with this function too.

Another long-standing problem with venetian blinds has been the passage of light through the holes which are provided in the slats to accommodate the lift cords. Light transmission through these holes has been unavoidable even when the blind is closed.

Another characteristic of typical venetian blinds and which inhibits some prospective users of them, is the time consuming function of cleaning them. Various types of equipment have been employed domestically and commercially to clean venetian blinds.

It is a general object of the present invention to overcome one or more of the foregoing disadvantages of typical, conventional venetian blinds.

SUMMARY OF THE INVENTION

Described briefly, according to one embodiment of the present invention, a venetian blind bottom rail is provided with a horizontal transverse hole through the rail near each end and receiving a ladder cord (sometimes referred to as a "cable tape") through it. Another horizontal hole opening at the rear of the rail extends obliquely into intersection with the transverse hole at a location midway between the front and rear of the rail. A vertical hole extends down from the top of the rail to this point of intersection. A lift cord extends down through the top of the rail and into the oblique hole where a knot on the lift cord fixes the end of the cord in the oblique hole. This enables the entire bottom surface of the bottom rail to be entirely smooth from end-to-end.

In another embodiment of the present invention, a horizontal transverse hole is provided in the bottom rail at a location spaced from each end of the rail, as in the first embodiment, and receives the ladder cord through it. But in this embodiment, another transverse hole is provided in the bottom rail above the first one and parallel to it and receives lift cords at the front and rear of the bottom rail. These lift cords, as well as the ladder cords, extend entirely up to the headrail. The lift cords extend horizontally through the headrail and out an opening near the end, where they are converged, knotted and coupled to a braided pull cord to lift and lower the blind. Each of the slats in the blind has a notch at the front edge and at the rear edge, and which receives the corresponding lift cord and ladder cord. Nevertheless, these notches are so small that when the blind is closed, there is unnotched surface of the next adjacent slat at the notched location in that slat but which covers the notch of the next adjacent slat so as to prevent any light from passing through the blind when it is closed. Also, since the bottom surface of the bottom rail is completely smooth, and since the ladder cord can slide either way in the lower transverse hole, the bottom rail can remain flat on the sill even when the blind is closed, and prevent light from passing through at that location.

In a further embodiment of the present invention, the slats are notched as described above for the second embodiment to receive the lift cords. But, instead of having the transverse hole through the bottom rail for the ladder cord, decorative ladder tapes are fastened to the front and rear faces of the bottom rail below the lift cord, and the decorative tapes extend up the front and rear faces of the blind in front of and behind the front and rear lift cord, respectively, thus concealing the lift cords. The bottom surface of the bottom rail is completely smooth and can remain flat on the sill when the blind is closed.

DESCRIPTION OF THE PREFERRED EMBODIMENT

Figure 1:
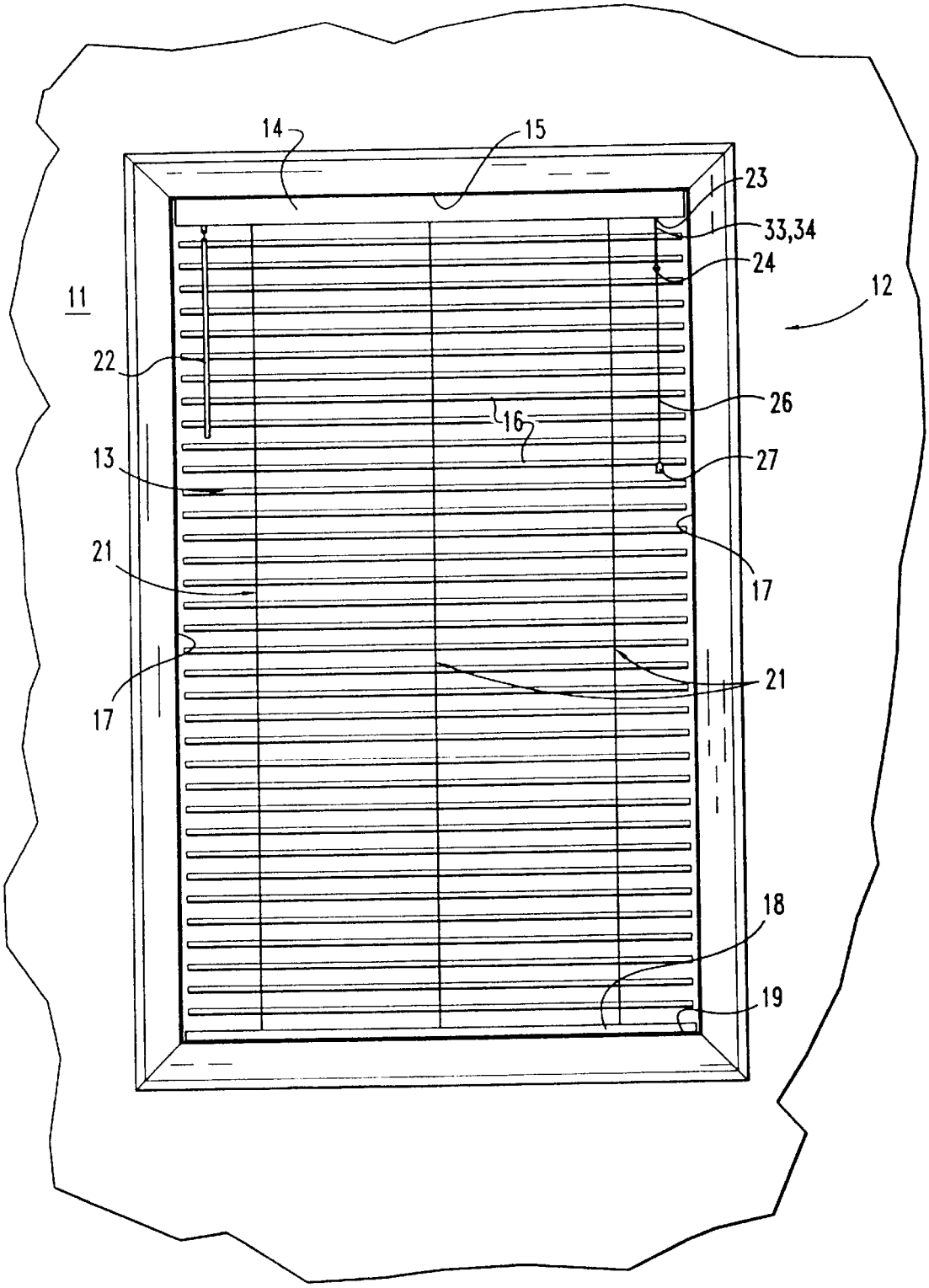
FIG. 1 is a front elevational view of a building wall with a venetian blind of the present invention installed in a window opening.
Figure 2:
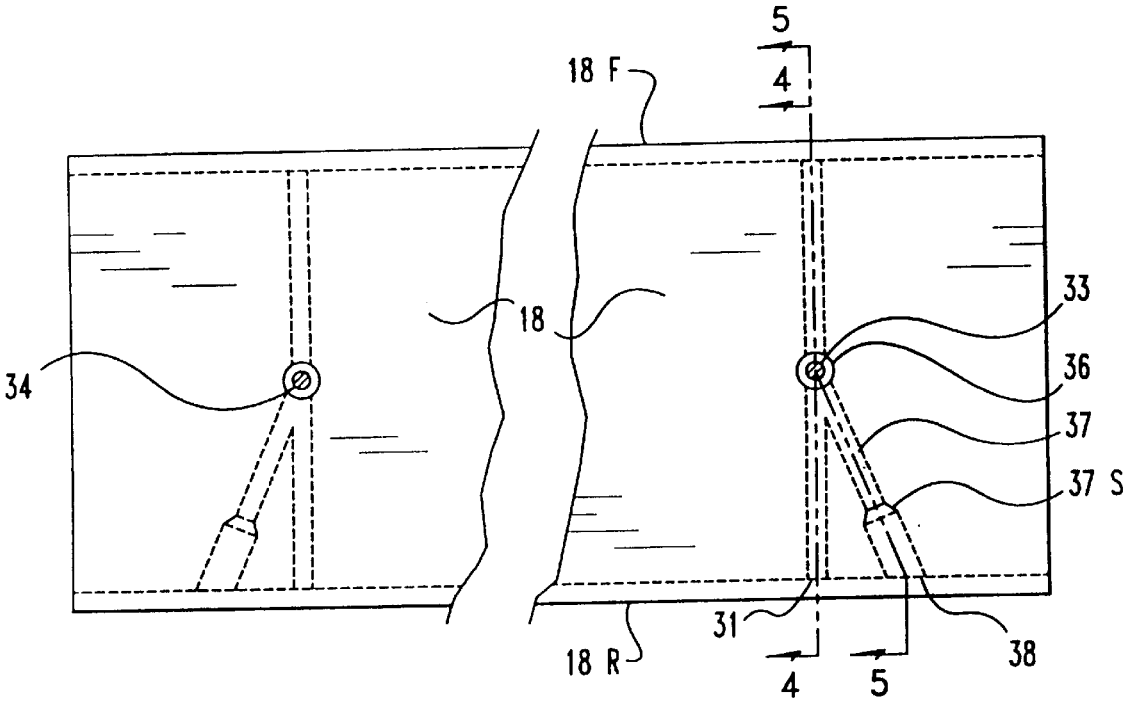
FIG. 2 is an enlarged top plan view of the bottom rail with a portion broken out to conserve space.
Figure 3:
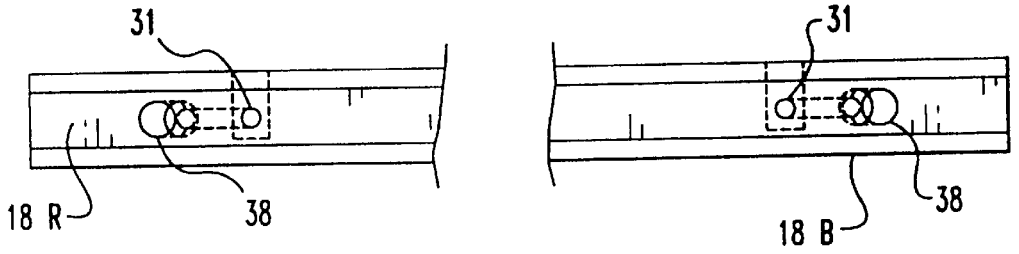
FIG. 3 is a rear elevational view of that portion of the bottom rail shown in FIG. 2.
Figure 4:
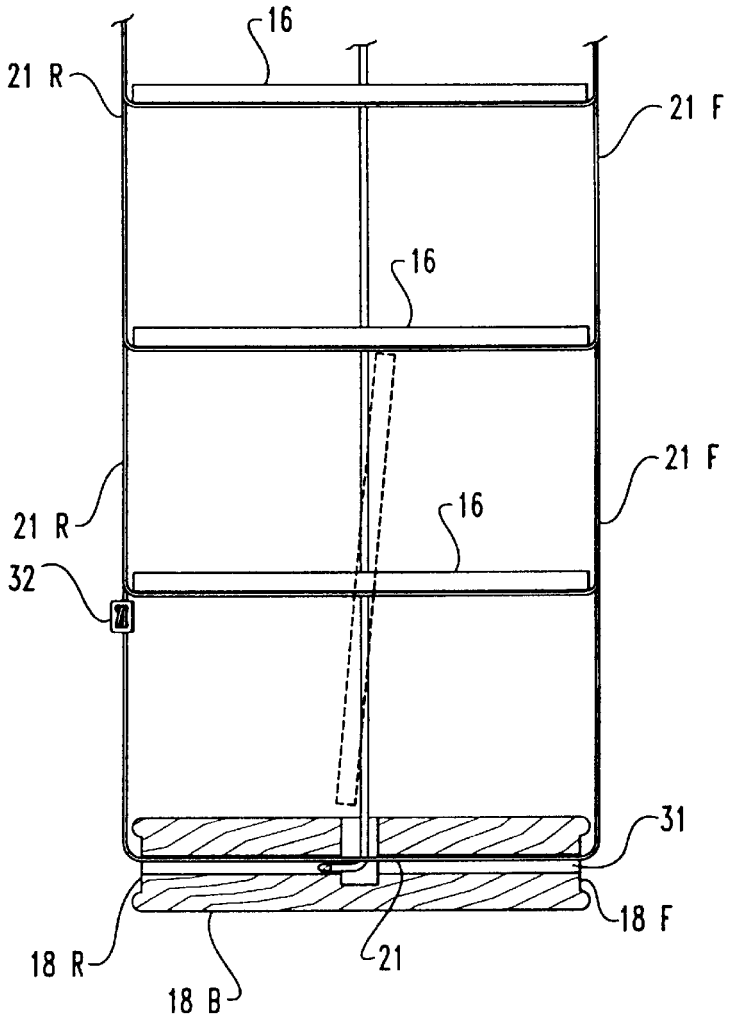
FIG. 4 is a fragmentary end view of the blind with the bottom rail shown in section taken at line 4—4 in FIG. 2 and viewed in the direction of the arrows.
Figure 5:
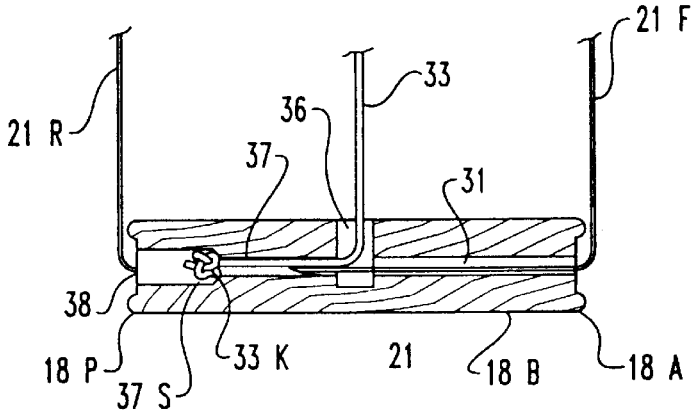
FIG. 5 is a sectional view of the bottom rail taken at line 5—5 in FIG. 2 and viewed in the direction of the arrows.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, FIG. 1 shows the interior wall 11 of a building with a window opening 12 and a venetian blind 13 according to one embodiment of the present invention set into the window opening 12. In this particular case, the entire blind is set in the window opening with the headrail 14 secured at the bottom 15 of the window opening header, slats 16 extending with their ends immediately inside the sides 17 of the window opening and the bottom rail 18 of the blind resting on top of the sill 19 at the bottom of the window opening. It should be understood that the blinds of all three embodiments of the present invention could be mounted in front of the window opening with the headrail above the top of the window opening, the slats extending to each side of the window opening in front of the wall surface, and the bottom rail resting on a wood trim window sill extending into the room or, in the absence of a window sill, hanging in front of the wall below the bottom of the window opening.

Throughout the description which follows, when reference is made to the front and rear of various components, it should be understood that the rear refers to the window side of the blind and the front refers to the other side which, in the case of a window in an outside wall, is the room side of the blind. Now further referring to FIG. 1, the illustrated blind has three ladder cords 21 (sometimes referred to as "cable tapes"), two of them being near each end of the bottom rail and one intermediate the ends. They extend entirely to the top of headrail 14. The horizontal strands attached to these ladder cords support the slats. The ladder cords are operated by rotating the tilt control wand 22 to open and close the slats. Of course, it should be understood that a tilt control cord can be used instead of a wand, in all three versions of the blind. Right-hand and left-hand lift cords 33 and 34 (upper ends shown at the headrail in FIG. 1) are connected to the bottom rail 18 and extend up through holes in the slats to the inside of the headrail 14 and extend to the right and out the hole 23 in the bottom of the headrail, where they are tied together and tied to a single pull cord 26 with a knob 27 at the lower end. The knots are covered with a decorative wood ball cap 24 that can be painted or stained to match the slats. It should be understood that the upper ends of the lift cords can be brought out of the headrail anywhere desired. Also the headrail shown in all embodiments is an upwardly opening channel-shaped housing of rectangular cross-section, but it could have other shapes. It has a rocker shaft therein operable by the tilt wand 22 or a tilt cord to tilt the slats to open and close the blind. It also houses the lift cord portions which extend lengthwise through the housing to the hole 23 in the bottom of the housing where the ends are brought out for connection to the pull cord 26.

Referring now to FIGS. 2 through 5, FIG. 2 is a top plan view showing both ends of the bottom rail 18, with the intermediate portion being omitted to conserve space in the drawing. As shown by comparing FIGS. 3, 4 and 5, the bottom surface 18B of the bottom rail is entirely smooth and flat, from end-to-end. It has no ladder cord, ladder tape, lift cord, or knots or pins touching it, projecting from it, or extending through it. If there is some reason to decorate the bottom surface for added interest or otherwise when the blind is raised and the underside can be readily seen, that can be done. In any case, it is free of any lift or tilt implementing functional features. To achieve this, at a location near each end, several horizontal holes are provided. Their nature and function at each end are the same, so a description of one will suffice for all. For example, hole 31 is provided entirely through the bottom rail from the rear face 18R to front face 18F transverse to, and in the illustrated example, perpendicular to the longitudinal axis of the rail. This hole receives the ladder cord 21 through it, with the front run 21F of the ladder cord extending up the front face 18F of the bottom rail, and the rear run 21R of the ladder cord extended up from the hole 31 against the rear face 18R of the bottom rail. The remainder of the ladder cord up to the headrail 14 is used to support the slats 16 in conventional manner. For convenience of installation, a metal clip 32 connects the piece of ladder cord running from the front 21F through the hole 31 and up at the rear, to the piece at the rear 21R descending from the headrail. The ladder cord 21 is free to slide in the hole as the ladder cord is moved to tilt the slats, but permit the bottom rail 18 to remain flat (untilted) on the window sill 19.

According to another feature of this embodiment of the invention, each of the two lift cords 33 and 34 is received down through a hole such as 36 in the top of the bottom rail and extends into an oblique hole 37 (FIGS. 2 and 5) which extends from the intersection of the hole 36 with hole 31 and out to the opening 38 at the rear face of the bottom rail. Hole 37 has a step in it at 37S so that the knot 33K (FIG. 5) engages the step and stops the cord 33 from being pulled through hole 37 and out the top hole 36 after the cord has been installed. In other words, for installation of lift cord 33, the lower end of it is passed down through the hole 36 and transversely through hole 37 and pulled out the opening 38 at the rear end, whereupon it is knotted and then the lift cord is pulled back into the hole 37 with the knot 33K stopping at the shoulder 37S in hole 37, and thus securely anchoring the lift cord in the bottom rail. The other ends of lift cords 33 and 34 are passed through the interior of the top or headrail 14 and out the hole 23 at the bottom right-hand (it could be left-hand) side of the headrail. The ends are knotted together and tied to the upper end of pull cord 26, and the knots are covered with the decorative wood ball 24. With the pull cord so connected to the lift cords, the blind assembly can be raised and lowered at will by using the pull cord 26. The inclination of the slats from a full open to a full closed condition with the front edges of the slats up or down, as desired, can be readily accomplished by the tilt wand 22 or a tilt cord. Thus, it is seen that, with the present invention, the bottom surface of the bottom rail can be entirely flat and smooth. Also, since the ladder cords can slide in the holes 31 as the slats are tilted closed, the bottom rail does not tilt and can remain untilted flat on the sill and maintain a snug seal with the window sill regardless of whether the blind is closed by tilting the slats forward (front edges of the slats down), or tilting the slats back (front edges up). Even if the bottom rail tilted, either the smooth front edge 18A or smooth rear edge 18P of the bottom rail would rest flat on the sill.

Referring now to FIGS. 6 through 12, there is shown a second embodiment of the present invention. In this case, the wall and window, headrail, tilt control wand 22 or cord, and pull cord 26 are given the same reference numerals as in the previous embodiment, because they can be the same. The ladder cord and installation can also be the same, but is given a difference reference numeral because the relationship to the lift cords and slats is slightly different.

In the FIGS. 6 through 12 embodiment, the bottom rail 41 has, near each end, a pair of transverse holes 42 and 43, entirely through the rail from the rear face 41R to the front face 41F. The lower holes 42 receive ladder cord portions 44F at the front and 44R at the rear, with a metal clip 46 fastening the two ends of the ladder cord at the rear of the blind. The ladder cord portion 44 is received in the hole 42, just as the ladder cord portion 21 in the FIGS. 1 through 5 embodiment is received through hole 31.

Figure 7:
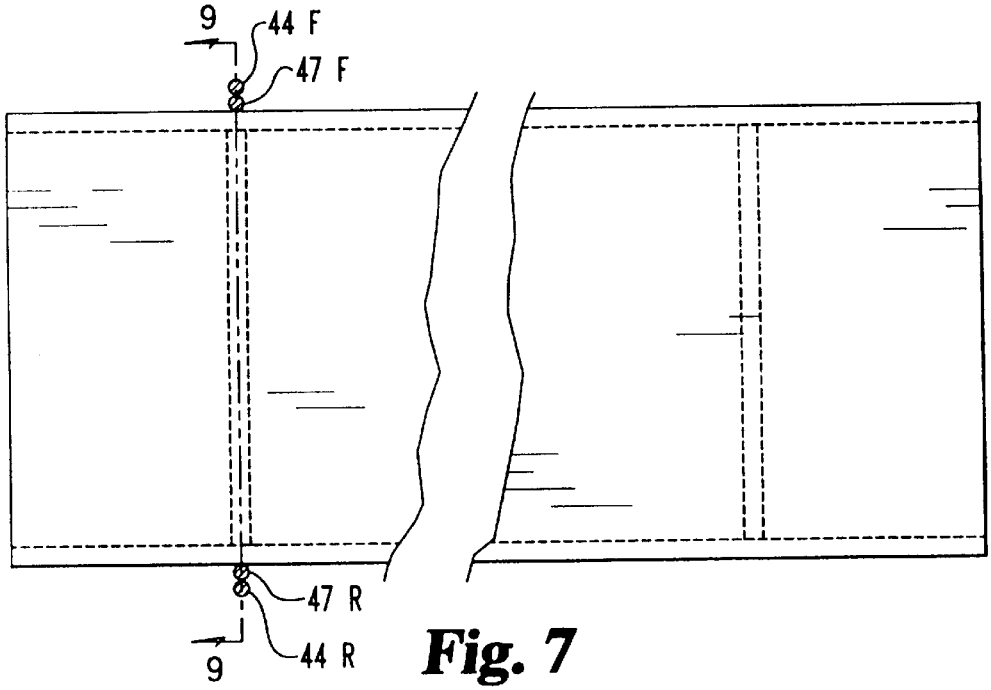
FIG. 7 is an enlarged top plan view of the bottom rail of that embodiment with a portion broken out to conserve space.
Figure 8:
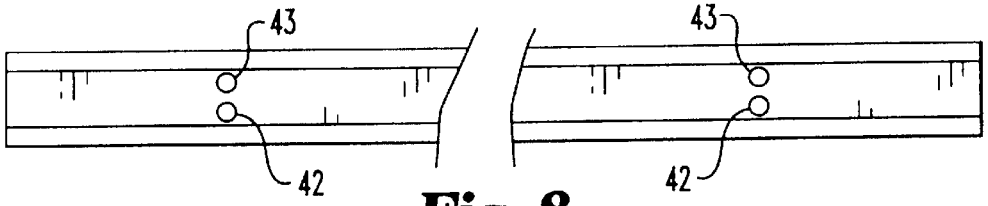
FIG. 8 is a front elevational view thereof.
Figure 9:
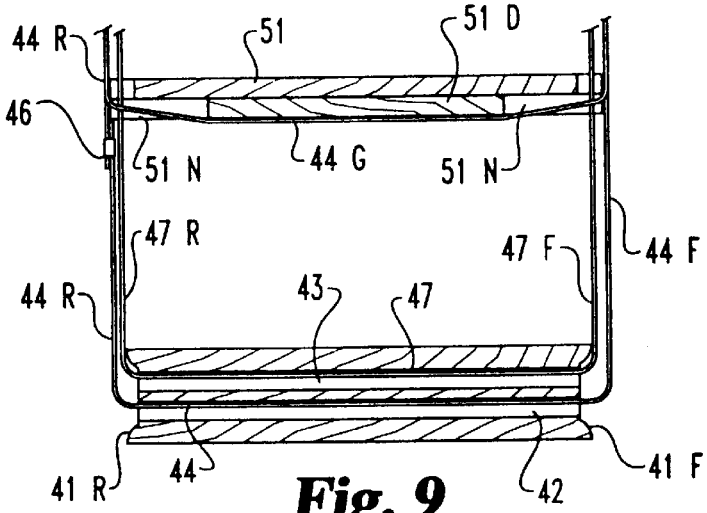
FIG. 9 is a section therethrough taken at line 9—9 in FIG. 7 and viewed in the direction of the arrows.

Referring further to FIGS. 7 and 9, the lift cord 47 extends through the hole 43, and portions 47F at the front and 47R at the rear extend up at the front and rear faces, 41F and 41R respectively, of the bottom rail, to holes in the bottom of the headrail 14 and across to the right or left and down and out through opening 48 in the bottom of the headrail 14. The ends of the lift cords are tied together below the headrail and are tied to pull cord 26. The knots are covered by the decorative wood ball 49.

Figure 10:
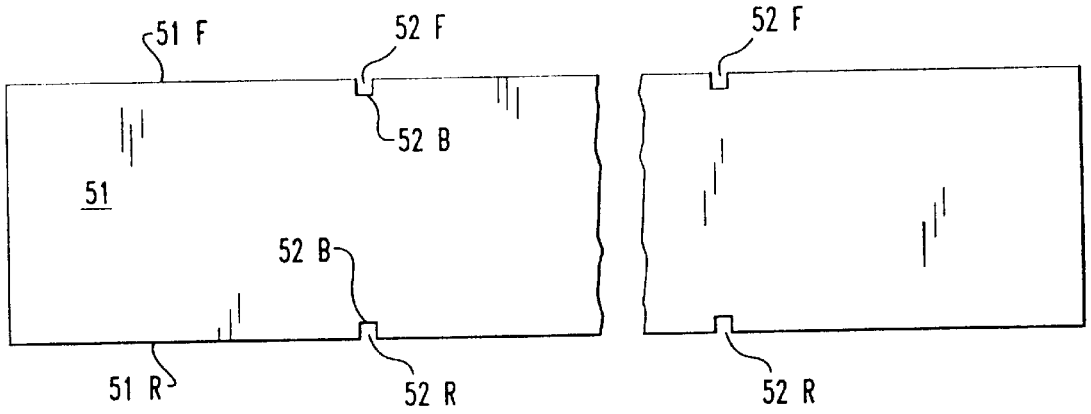
FIG. 10 is a top plan view of a slat thereof, on a smaller scale and with a portion broken out to conserve space.
Figure 11:
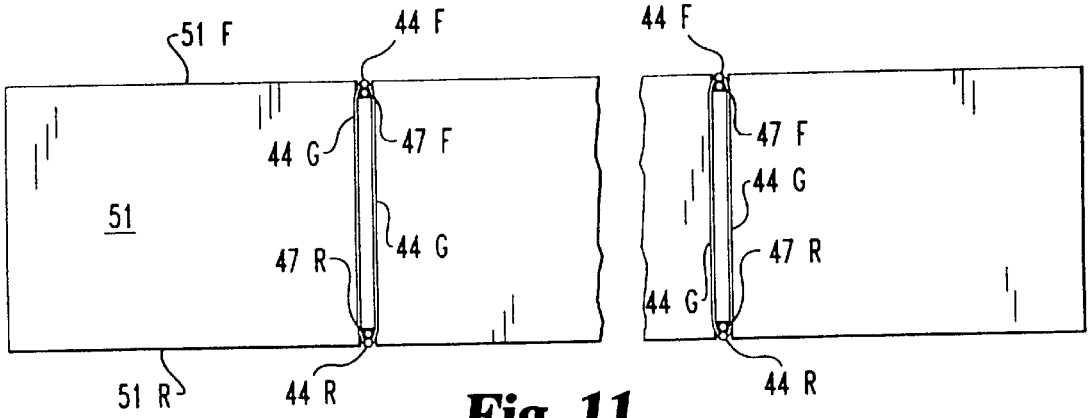
FIG. 11 is a bottom plan view of the slat thereof with the lift cord and ladder cord in edge notches in the slat.
Figure 12:
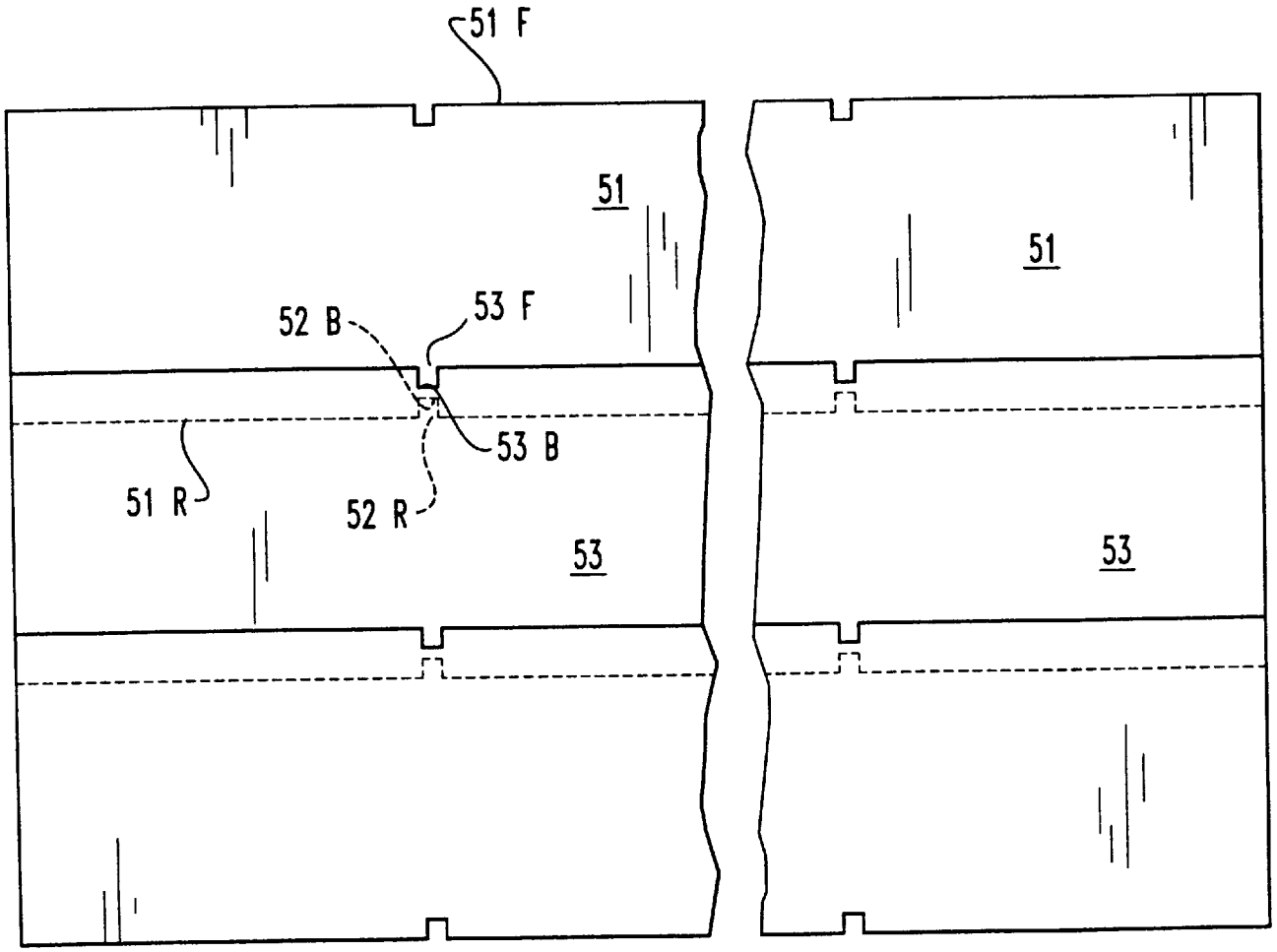
FIG. 12 is a front elevational view with the slats closed but omitting the cords, to show the light blocking feature.

An additional feature of this embodiment of the present invention is shown in FIGS. 10 through 12. All of the slats 51 from the headrail 14 to the bottom rail 41, are provided with notches 52F in the slat front edge 51F and notches 52R in the rear edge 51R, in vertical alignment with the holes 42 and 43 in the bottom rail 41. As shown in FIG. 11, these notches receive, at the inner margins 52B thereof, the lift cord portions 47F and 47R. The ladder cords 44F and 44R are in the notches outboard of the lift cords and about flush with the front and rear edges 51F and 51R, respectively, of the slat. Also, each of the "rungs" of the ladder has a pair of ladder strands 44G secured to the ladder cords. The lift cords are confined between the ladder rung strands under each slat. As the lift cords are pulled to raise the blind, they slide in the bottoms of these notches, while the ladder cords remain situated at the notches, as the slats collect while the blind is being raised or as the slats separate as the blind is being lowered. As an example, for a slat which is 50 mm deep from edge 51F to edge 51R, the distance between the bottoms 52B of the notches 52F and 52R, is approximately 45 to 45.5 mm.

Figure 17:
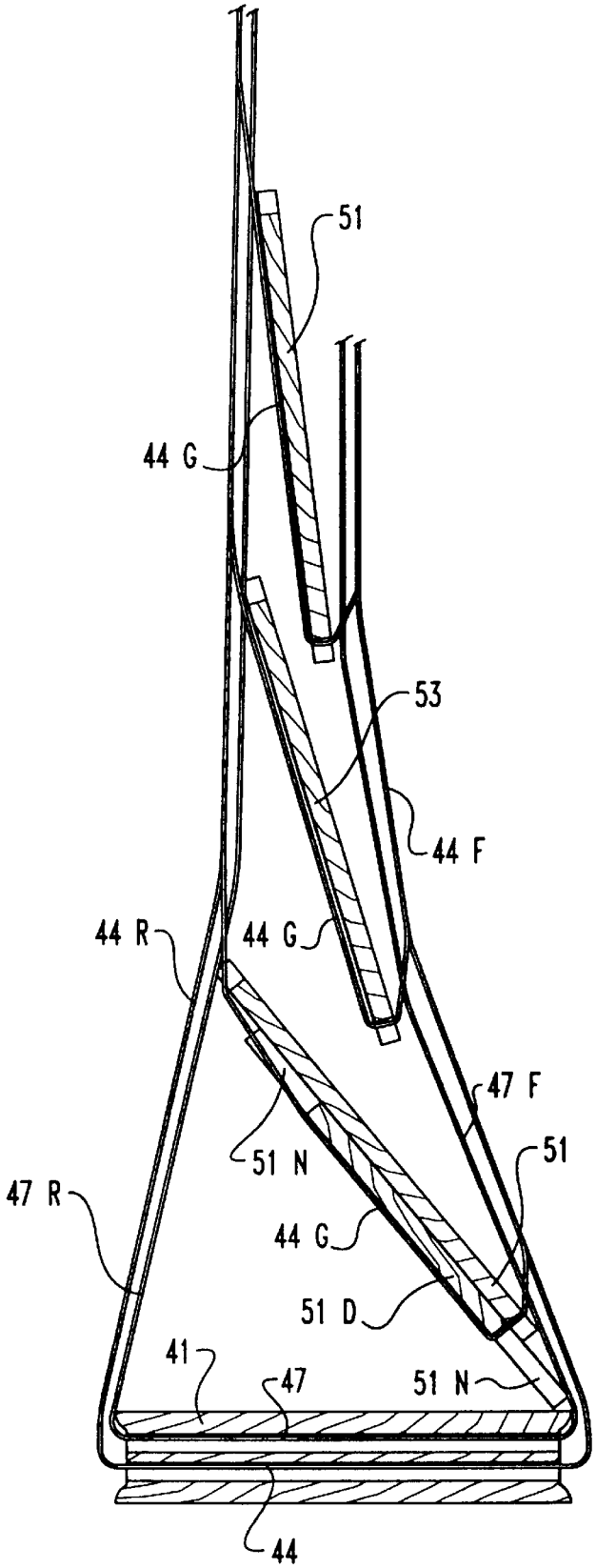
FIG. 17. is a sectional view similar to FIG. 9 but showing the blind closed with a supplemental, light stop bottom slat.

The spacing of the slats is such that, when the blind is closed, there is sufficient overlap between the unnotched portions at the notch locations that no light can pass through from the inside to the outside (or vice versa) of the blind. This is represented in FIG. 12 where, for slats 51 and 53, for example, the bottom 53B of the notch 53F in slat 53 is above the bottom 52B of the notch 52R of slat 51. This overlap, in addition to the fact that the lift cords and ladder cords (not shown in FIG. 12 in order to avoid confusion in the drawing) are also in these notches, makes it quite impossible for light to get through from the front to the rear of the blind at these locations. In this embodiment, as in the previously described embodiment, the absence of lift cord or ladder cord features from the bottom surface of the bottom rail enables a light and air seal between the bottom rail and a window sill when the blind is lowered and regardless of whether the blind is closed with the front edges of the slats down or the rear edges of the slats down. Also, when the blind is closed, as well as when it is open, the bottom rail can rest flat (untilted) on a window sill without any tendency to gap or be unstable. Also if needed to insure prevention of light leak at the top of the bottom rail, a supplemental, light stop slat 51D can be included on the support strands 44G for the bottom slat 51, with the bottom slat resting on slat 51D. This slat 51D has deeper notches 51N (only 30 mm between their bottoms) so the supplemental slat can slide down farther on the lift cords and the support strands (which then enter the notches 51N at the front edge of the supplemental slat as shown in FIG. 17) when the blind is closed and close any gap at the top of the bottom rail.

Figure 13:
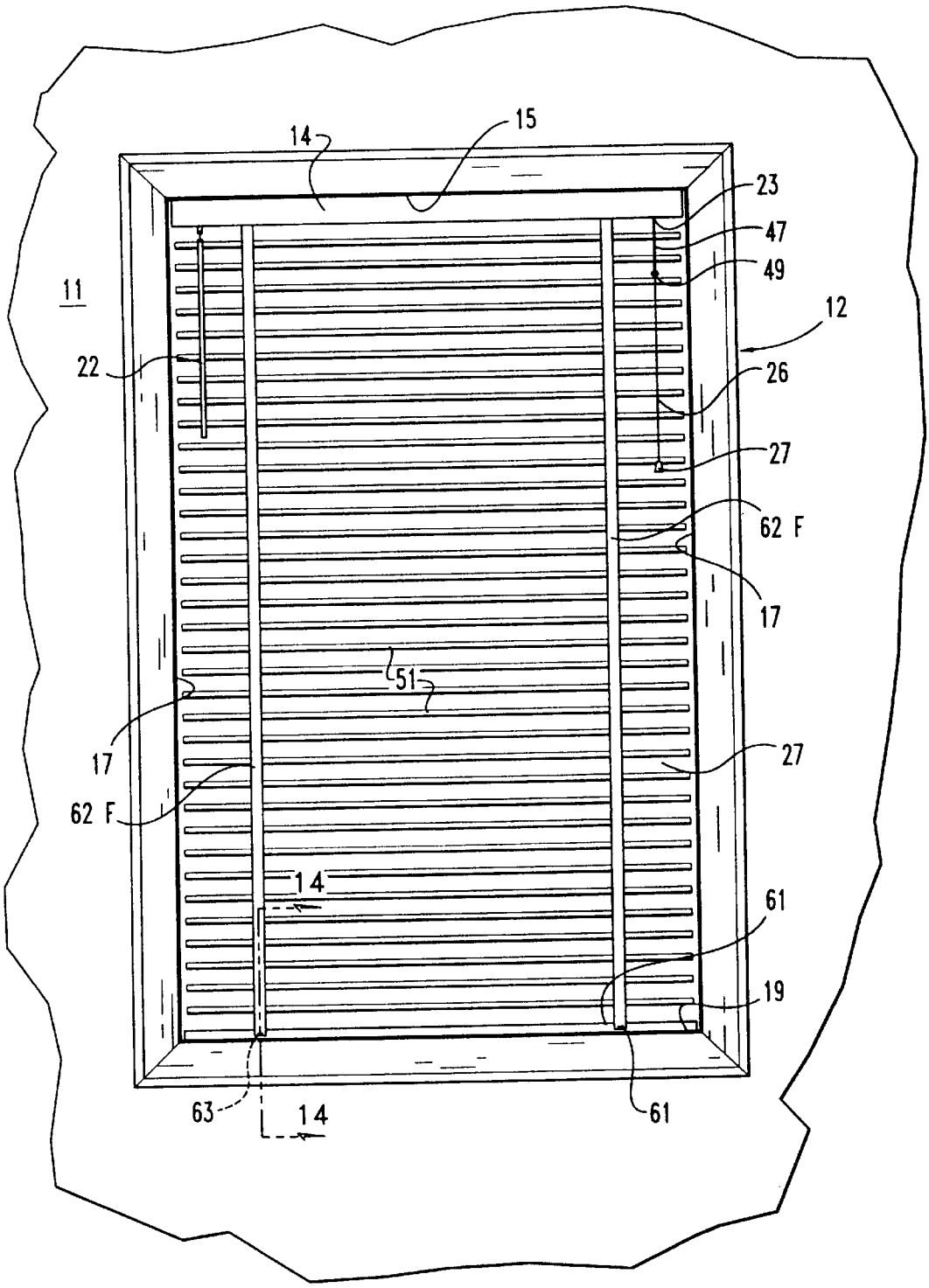
FIG. 13 is a front elevational view of a blind according to a third embodiment of the invention installed in a window opening, and having decorative ladder tapes instead of ladder cords.
Figure 14:
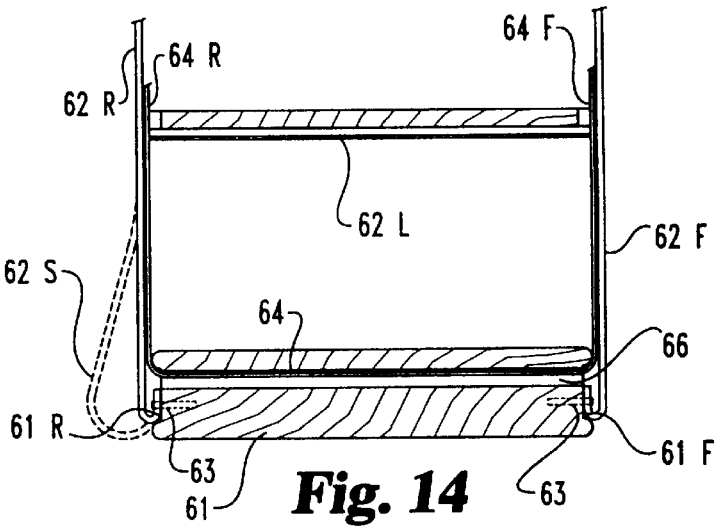
FIG. 14 is an enlarged cross sectional view through the bottom rail and one slat taken at line 14—14 in FIG. 13 and viewed in the direction of the arrows.
Figure 15:
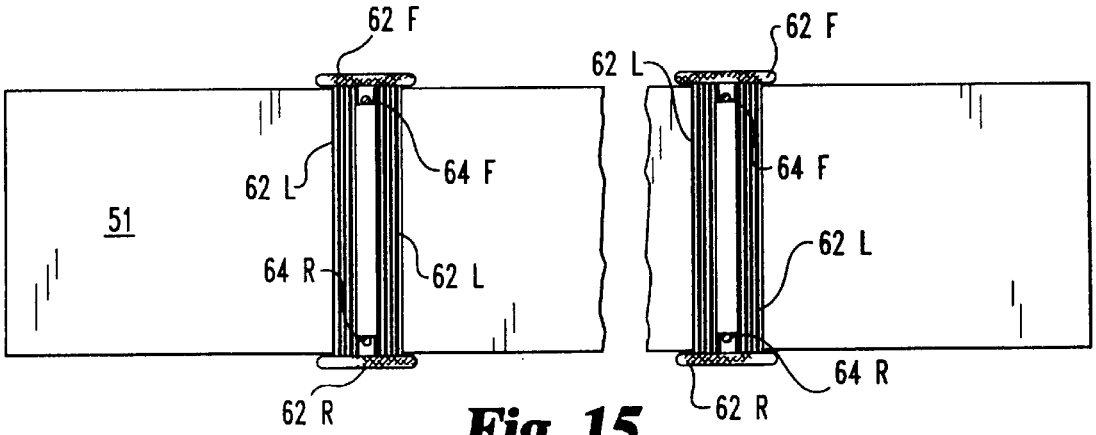
FIG. 15 is a bottom plan view on a smaller scale than FIG. 14, and similar to FIG. 11 but showing the decorative ladder tapes covering the lift cords.
Figure 16:
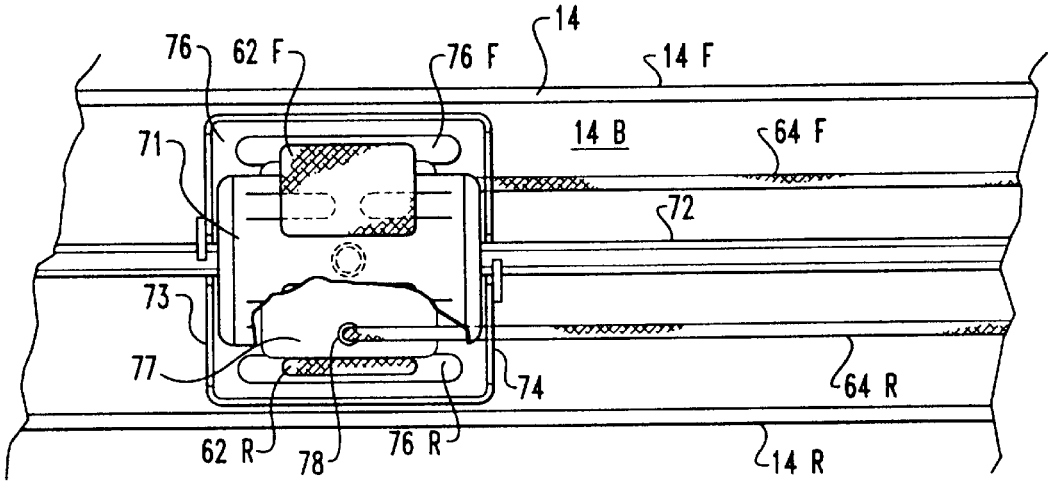
FIG. 16. is a fragmentary top plan view of the headrail of the FIG. 13 embodiment.

Referring now to FIGS. 13 through 15, the blind construction can be essentially the same as in the embodiment of FIGS. 6 through 12 with the exception that, instead of the ladder cords for supporting the slats and closing and opening the blind, decorative ladder tapes are used. Although the bottom rail can be identical to that in FIG. 6, it does not need the additional holes 42 for ladder cords, so it is given a reference numeral 61. In this case, the lift cords and other features can be the same as in the FIG. 6 embodiment, so are given the same reference numerals. But decorative ladder tapes are used instead of ladder cords. For the left-hand side of the blind, a ladder tape 62 is used with the front portion of the tape 62F extending down from connection on a roll 71 (FIG. 16) in the headrail 14 and the rear portion 62R extending down from connection on the roll to the rear face 61R of the bottom rail 61. The ladder rung strands 62L are connected in pairs to the tapes 62F and 62R, and the lift cords 64F and 64R are confined between the strands of each pair for each slat from the headrail to the bottom rail. The lower end of the tape 62F is stapled as at 63 (FIG. 14) to the front face 61F of the bottom rail. The tape is then folded up from there and extends upward to its connection to the roll 71 inside the headrail (FIG. 16). The staples are covered by the overlapping portion of the tape where it folds upward. The rear tape 62R is stapled to the rear face 61R of the bottom rail in the same manner. Lift cord 64 extends through the transverse hole 66. The front portions 64F of the lift cords extend up the front of the bottom rail and, as shown in FIG. 15, are laced between the pair of strand sets 62L of each rung and are located in the front notches of the slats and are covered by the front tapes 62F. The rear portions 64R of the lift cords extend up from the rear of the bottom rail and are laced between the pair of strand sets 62L of each rung and are located in the rear notches in the slats and are covered by the rear tapes 62R. In this embodiment, as in the previous embodiments, the opening and closing of the slats is controlled by the tilt control wand 22 or cord in the same manner. Also, the notches in the front and rear edges of the slats are sized such that the lift cords fit neatly in the notches but are confined therein by the ladder tapes and are hidden thereby.

In the FIGS. 6 through 12 version of the blind, the ladder cords and lift cords can pass through the same holes in the bottom of the headrail. With suitable grommets in these holes, the lift cords can easily turn to the right or the left, depending upon where the lift cords are to be taken out of the headrail to the pull cord, but remain aligned with the ladder cords as they move into and out of the headrail during raising and lowering the blind. But in the FIGS. 13 through 16 embodiment of the invention, since the ladder tapes are wider, the openings through which the ladder tapes enter the bottom rail must be larger and would not necessarily neatly confine the lift cords. Therefore, and referring to FIG. 16, a portion of the headrail is shown looking into it from the top. The tape mounting roll 71 is mounted on horizontal rocker shaft 72 which, although hexagonal in cross-section, is cradled in upwardly extending arms 73 and 74 of a bracket whose base 76 is secured to the bottom 14B of the headrail channel between the upstanding front and rear faces 14F and 14R of the headrail channel. The bracket base has guide holes 76F and 76R for the front and rear ladder tapes. To guide the lift cord portions 64F and 64R up into and then horizontally inside the headrail, a plastic guide plate 77 is secured atop the base 76 and has a hole 78 therein for each of the two lift cords (the hole for the front cord being hidden under the tape roll 71) and thereby maintains them centered between the left and right-hand edges of the tape receiver holes to maintain the lift cords hidden properly behind the ladder tapes in the region between the upper slat and the bottom of the headrail. The lift cords can slide vertically relative to the slats as needed to lift and thereby raise the bottom rail and permit the slats to close together as the blind is raised, and to separate as the blind is lowered and, at all times remain hidden neatly behind the ladder tapes. The lift cords and notches prevent the slats from shifting right to left and vice versa in the normal operation of the blind.

If it is desired to have the bottom rail of the third version of the blind remain entirely flat on the sill without tilting when the rest of the slats are tilted, the ladder cord between the bottom slat supporting strand 62L and the bottom rail can be made extra long to provide some slack as represented by the modest loop of ladder tape shown dotted at 62S at the rear of the blind in FIG. 14. This will enable lifting the rear ladder cord 62R to tilt the slats forward, without tilting the bottom rail forward. If it is desirable to tilt the slats back instead of forward while at the same time keeping the bottom rail 61 untilted, the extra length of ladder tape can be provided at 62F as shown for the rear ladder cord in FIG. 14. For most applications, without extra slack in the ladder tape between the bottom slat and the bottom rail, the space between the bottom slat and the bottom rail will be the same as between each slat and the next adjacent slat above and below it so, when the slats are tilted, so is the bottom rail. Nevertheless, because the front and rear bottom edges of the bottom rail are straight and flat, the front bottom edge can remain flat on the window sill when the blind is closed by tilting the slats forward, or the bottom rear bottom edge of the bottom rail will remain flat on the window sill when the blind is closed with the slats tilted back.

Figure 6:
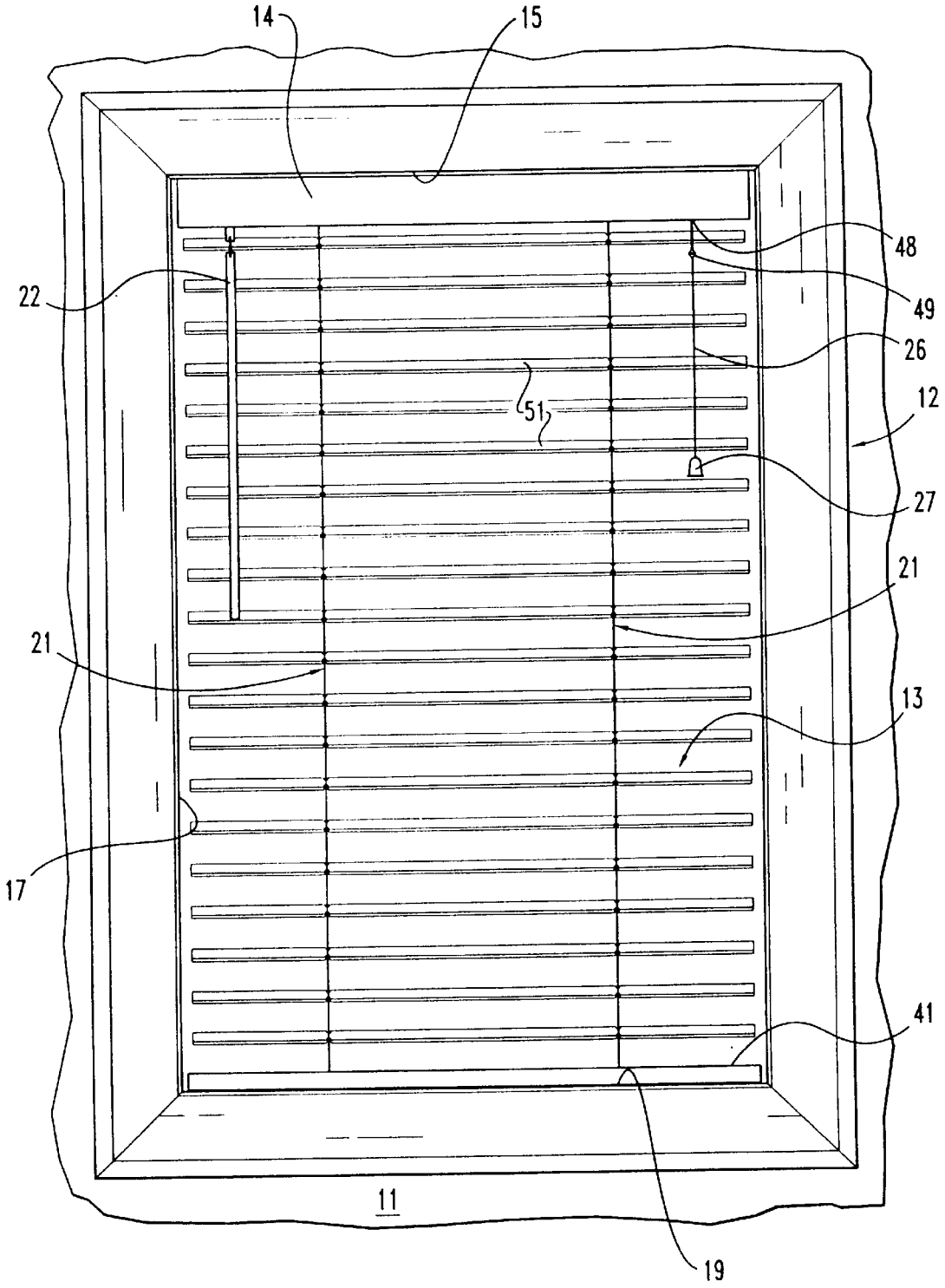
FIG. 6 is a front elevational view of a blind according to the second embodiment of the present invention installed in a window opening.

In addition to the light blocking features of the blinds of the FIGS. 6 and 13 embodiments, these blinds also have the feature of ease of cleaning. For example, because the lift cords reside in notches in the front and rear edges of the slats, the blind can be lowered and, with the blind open, the slats can be manually tilted about their longitudinal axes without turning the tilt wand 22 or cord, and thereby disengaged from the lift cords and ladder cords and pulled out the end of the blind individually and cleaned. After cleaning, they can be reinserted and reoriented to the horizontal-open position receiving the lift cords (and ladder cords in the FIG. 6 embodiment) in the front and rear edge notches of the slats. In the FIG. 13 embodiment, only the lift cords are received in the notches as the front and rear edges of the slats are in flush engagement with the inner faces of the ladder tapes.

The illustrated example of FIG. 1, shows a blind having three ladders in it. For blinds that are 60 inches or less in width, lift cords behind the ladder cords or tapes adjacent the ends, without an additional lift cord or cords centered between the ends, are usually sufficient. For heavier blinds, 60 inches or above, additional lift cords will be employed at additional locations in the same manner as those described herein. For narrower or lighter blinds, the ladder cord or ladder tape midway between the ends of the slats may be omitted as in FIGS. 6 and 13.

As an example, lift cords in the practice of the present invention can be made of nylon 1.2 mm outside diameter for the FIGS. 1 and 6 versions and 1.8 mm diameter for the FIG. 13 version. The ladder cords for the FIGS. 1 and 6 version are normally stranded and 1.4 mm in outside diameter. The decorative tapes for the FIG. 13 version are normally provided in approximately ½, ¾, 1 and 1.5 inch widths. In the case of wood slatted blinds, the typical depth is about 1 inch, 2 inches, or 3 inches, depending upon the application. It will be recognized that the present invention can be incorporated in a wide variety of sizes, styles, and materials, depending upon the application.

From the foregoing description, it can be recognized that the present invention very well overcomes the above-mentioned disadvantages of prior art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a venetian blind assembly having a headrail, a bottom rail having a top and a bottom and a front and a rear, a plurality of horizontal slats, a flexible ladder assembly holding the slats in vertically spaced relationship in a series, lift cords to raise and lower the blind, the blind having a front and a rear, the improvement comprising:

engagement of the ladder assembly with the bottom rail only at locations above the bottom; and wherein the bottom rail has a transverse hole extending through the rail from the rear to the front;

the ladder assembly has a cord extending through the transverse hole and upward from the rear of the bottom rail to the headrail and upward from the front of the bottom rail to the headrail;

the bottom rail has a second transverse hole extending through the rail from the rear to the front;

one of said lift cords extends through the second transverse hole and up from the front of the bottom rail to the headrail and upward from the rear of the bottom rail to the headrail; and the second transverse hole is above the first-mentioned transverse hole.

2. The improvement of claim 1 and wherein:

the slats have front and rear edges, and notches in the front and rear edges;

pairs of ladder rung strands are provided under the slats; and the one lift cord extends upward from the bottom rail in the notches in the slats, and is located between the strands of each pair.

3. The improvement of claim 2 and wherein:

the upwardly extending cord of the ladder assembly extends upward from the front of the bottom rail in the notches in the front edges of the slats, and it extends upward from the rear of the bottom rail in the notches in the rear edges of the slats; and each of the slats is supported by a pair of ladder rung strands connected to the ladder assembly cord in the notches in front edges of the slats and to the ladder assembly cord in the notches in the rear edges of the slats; and the lift cord is located between the strands of the pair for each slat.

4. In a venetian blind assembly having a headrail, a bottom rail having a top and a bottom and a front and a rear, a plurality of horizontal slats, a flexible ladder assembly holding the slats in vertically spaced relationship in a series, and lift cords to raise and lower the blind, the blind having a front and a rear, the improvement wherein:

the bottom of the bottom rail is flat;

one of said lift cords extends upward from the front of the bottom rail to the headrail;

one of said lift cords extends upward from the rear of the bottom rail to the headrail;

the slats have front and rear edges, and notches in the front and rear edges receiving the lift cords;

whereby the slats are normally retained in the ladder assembly but are separately rockable on their longitudinal axes to release the lift cords from the notches and enable removal of the rocked slats from the ladder assembly by movement in the direction of the longitudinal axes of the slats;

the flexible ladder assembly includes a pair of rung strands adjacent each lift cord at each slat and holding the slats in vertically spaced relationship; and the one lift cord extending upward from the front of the bottom rail is located between the adjacent strands of the pair for each of the slats; and the one of the lift cords extending upward from the rear of the bottom rail is located between the strands of the pair for each of the slats.

5. In a venetian blind assembly having a headrail, a bottom rail having a top and a bottom and a front and a rear, a plurality of horizontal slats, a flexible ladder assembly holding the slats in vertically spaced relationship in a series, and lift cords to raise and lower the blind, the blind having a front and a rear, the improvement wherein:

the bottom of the bottom rail is flat;

one of said lift cords extends upward from the front of the bottom rail to the headrail;

one of said lift cords extends upward from the rear of the bottom rail to the headrail;

the slats have front and rear edges, and notches in the front and rear edges receiving the lift cords;

whereby the slats are normally retained in the ladder assembly but are separately rockable on their longitudinal axes to release the lift cords from the notches and enable removal of the rocked slats from the ladder assembly by movement in the direction of the longitudinal axes of the slats;

ladder cords extending up from the bottom rail to the headrail at the front and rear edges of the slats; and ladder rung strands connected to the ladder cords at the front and rear of each slat and supporting the slat, and enabling tilting of the slats to close the blind when the ladder cords at the front and rear edges of the slats are moved in opposite directions, one of the slats being a bottom slat;

the improvement further comprising:

a supplemental slat under the bottom slat and having front and rear edges and notches in the front and rear edges that are deeper than the notches in the other slats;

the deeper notches enabling the supplemental slat to slide downward into engagement of one of said edges thereof with the top of the bottom rail when the blind is closed to inhibit passage of light between the bottom slat and the top of the bottom rail.

* * * * *